US007984829B2

(12) United States Patent
Cittadino et al.

(10) Patent No.: US 7,984,829 B2
(45) Date of Patent: Jul. 26, 2011

(54) INTERCHANGEABLE ACCESS DEVICE FOR A DISPENSER

(75) Inventors: Antonio M. Cittadino, Appleton, WI (US); Alan P. Paal, New Franken, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 477 days.

(21) Appl. No.: 12/237,844

(22) Filed: Sep. 25, 2008

(65) Prior Publication Data

US 2010/0072227 A1 Mar. 25, 2010

(51) Int. Cl.
*B67B 1/00* (2006.01)

(52) U.S. Cl. ..... 222/153.03; 222/153.01; 222/153.09; 222/181.1; 222/181.3

(58) Field of Classification Search ..... 222/153.01, 222/153.02, 153.03, 153.09, 180, 181.1, 222/181.3, 160, 173
See application file for complete search history.

(56) References Cited

U.S. PATENT DOCUMENTS

| | | | | |
|---|---|---|---|---|
| 3,540,630 | A | 11/1970 | Brown et al. | |
| 4,391,111 | A | 7/1983 | Marcy | |
| 4,493,440 | A * | 1/1985 | von Buelow et al. | 222/109 |
| 5,183,182 | A * | 2/1993 | Comstock et al. | 222/129 |
| 5,253,786 | A | 10/1993 | Schmidt | |
| 6,131,773 | A * | 10/2000 | Wade et al. | 222/153.02 |
| 6,209,184 | B1 * | 4/2001 | Copeland et al. | 29/428 |
| 6,772,916 | B1 * | 8/2004 | Reynolds | 222/181.3 |
| 6,903,654 | B2 * | 6/2005 | Hansen et al. | 340/562 |
| 7,040,566 | B1 * | 5/2006 | Rodrian et al. | 242/563 |
| 7,051,987 | B2 | 5/2006 | Chen | |
| 7,232,045 | B2 * | 6/2007 | Ophardt et al. | 222/180 |

FOREIGN PATENT DOCUMENTS

| | | | |
|---|---|---|---|
| EP | 1702547 | A2 | 9/2006 |
| JP | 31003670 | U9 | 12/2003 |
| KR | 200171448 | Y1 | 4/2000 |
| KR | 200309198 | Y1 | 3/2003 |

OTHER PUBLICATIONS

International Search Report and Written Opinion for PCT/US2009/056173 mailed Apr. 12, 2010.
Partial Machine Translation of JP 03100367 U9 Printed Jun. 28, 2010.

* cited by examiner

*Primary Examiner* — Frederick C. Nicolas

(57) ABSTRACT

An interchangeable access device for a dispenser is provided. The interchangeable access devices include a push-button device and a keyed-device. Each of the access devices includes a retaining feature that allows the access device to be removably coupled to a dispenser cover. The access devices cooperate with a latch member to disengage the latch member from a catch coupled to a back-housing. The access devices may be removed and interchanged by a dispenser operator to reflect changes in the application environment.

20 Claims, 10 Drawing Sheets

INTERCHANGEABLE ACCESS DEVICE FOR A DISPENSER

BACKGROUND OF THE INVENTION

The present invention relates generally to a dispenser, and in particular to a dispenser that provides an interchangeable access feature to different levels of security to prevent unauthorized access to product within the dispenser.

Dispensing equipment is used in a wide variety of applications, such as in the delivery of soap or sheet product for example. Dispensers are used in self-service types of environments where a product is needed and it is uneconomical or undesirable to have a full time attendant. Typically, a user activates the dispenser and an internal mechanism accesses a supply of the product. The product is removed from the internal supply and provided to the user. Since the internal supply is not unlimited, dispensers usually include some type of cover or door that allows an operator to access the internal area of a dispenser, such as for maintenance tasks or restocking of product for example.

In some environments, it is desirable to secure the cover of the dispenser with a lock. The locking of the dispenser prevents unauthorized access that discourages theft of product and vandalism of the dispenser. However, the use of a lock increases the amount of time it takes for the operator to restock the dispenser. The lock may further create a logistical issue for the operator in making sure that maintenance personnel with the correct keys are dispatched to appropriate locations to prevent losing time if the maintenance personnel are unable to open the dispenser. To avoid this situation, operators in environments with less exposure to vandalism and theft typically install dispensers without locks. This unsecured cover is held closed by a simple catch arrangement. Unfortunately, this results in manufacturers and installers of dispensers having to fabricate and stock multiple models or stock keeping units (SKU's) of dispensers in order to meet the needs of end customers.

While existing dispensers are suitable for their intended purposes, there still remains a need for improvements, particularly regarding the access mechanisms for restocking the dispenser and the reduction of manufacturing costs through the use of interchangeable parts.

SUMMARY OF THE INVENTION

A dispenser is provided having a back-housing. A catch is coupled to the back-housing. A cover is movably coupled to the back-housing, the cover having a first opening. A latch is coupled to the cover, where the latch cooperates with the catch to hold the cover against the back-housing when the cover is in a first position. A push button lock is disposed to be removably coupled to the first opening. A keyed device is disposed to be removably coupled to the first opening. Wherein the push button lock and the keyed device are mutually interchangeable with each other for being removably coupled to the first opening by a user.

A dispenser is also provided having a back-housing with a first end and a second end. The back-housing includes a catch adjacent the first end. A cover has a first opening adjacent a third end, and a fourth end opposite the third end. The cover fourth end is coupled for rotation to the back-housing second end, wherein the cover is movable between a first position and a second position. A latch member is coupled to the cover. The latch member is removably coupled to the catch when the cover is in the first position. An interchangeable access device is provided having a tab. The tab is sized to allow the access device to be removably coupled to the cover in the first opening and operably coupled to the latch, wherein the access device is user selectable between a push-button device or a keyed device.

A dispenser kit is also provided having a back-housing that includes a catch. A cover is rotatably coupled to the back-housing at a first end, the cover movable between a first and second position and having a first opening. A latch is coupled to the cover adjacent the first opening and positioned to engage the catch when the cover is in the first position. A first access device is sized to movably fit in the first opening, the first access device being movable between a third position and a fourth position when positioned in the first opening. A second access device is sized to fit in the opening with a snap-fit, the second access device includes a second opening. Wherein the first access device and the second access device are mutually interchangeable with each other for being positioned in the first opening and wherein the first access device and the second access device each cooperate with the latch to disengage the latch from the catch.

BRIEF DESCRIPTION OF THE DRAWINGS

Referring now to the drawings, which are meant to be exemplary and not limiting, and wherein like elements are numbered alike.

DETAILED DESCRIPTION

Figure 1:
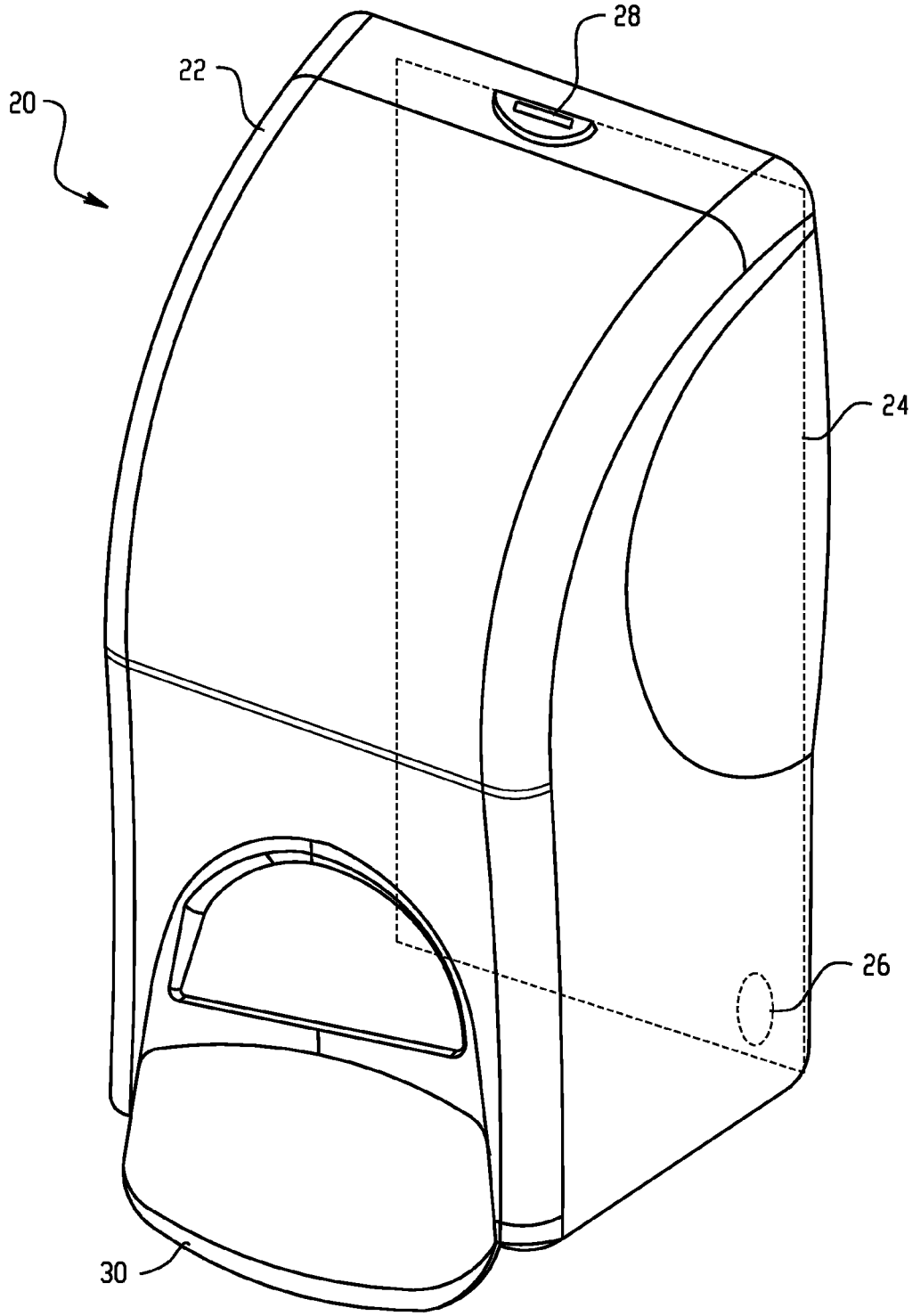
FIG. 1 is a perspective view illustration of a dispenser in accordance with an exemplary embodiment of the invention.

FIG. 1 illustrates an exemplary embodiment of a dispenser 20. The dispenser 20 may be any type of dispenser that provides a product when activated by a user. As such, the dispenser 20 may be a soap dispenser, a liquid soap dispenser, a foam dispenser or a sheet product dispenser for example. While reference may be made to soap or liquid soap, it will be appreciated that the scope of the invention is not so limited, and extends to other flowable products, such as liquid, foam, gel, lotion, detergent, or any other flowable product capable of being pumped from a dispenser, for example. Further, the term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), double re-creped (DRC), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

The dispenser 20 includes a front cover 22 and a back-housing 24 that are arranged to hold and dispense a product (not shown). In one embodiment, the cover 22 is coupled to the back-housing 24 by a hinge 26 and an access device 28. As will be discussed further herein, the access device 28 is an interchangeable device that allows the operator to change the security access to the internal portions of the dispenser 20. When the user activates the access device 28, the cover is allowed to rotate providing the operator with access to the internal portions of the dispenser 20. Once the operator has completed the desired tasks, such as refilling the supply of product for example, the operator rotates the cover until the access device 28 re-engages the back-housing 24.

The dispenser 20 may include further features that allow a user to interact and receive products. The dispenser 20 may have one or more handles 30 for example. When the handle 30 is pushed by the user an internal mechanism (not shown) is activated, such as a pump for example. The internal mechanism retrieves product from a supply and delivers the product to the user. Alternatively, the dispenser 20 may have a so-called "touchless" system that uses a sensor, such as an infrared sensor for example, that senses the presence of the user and provides the product in response.

In the exemplary embodiment, the cover 22 is formed from a material that is suitable for the environment in which operation is intended. The cover 22 may be formed from an injection molded plastic such as polypropylene or polyethylene for example. The cover 22 may further be made from a transparent or semi-transparent material such as poly (methyl methacrylate) (PMMA), polypropylene, polyethylene, polycarbonate or polysulphone for example. A transparent or semi-transparent cover 22 provides advantages to the operator in checking the supply of product remaining in the dispenser 20. The cover 22 includes a hole 32, shown in FIG. 2, which is sized to receive the access device 28. In the exemplary embodiment, the hole 32 is positioned in the cover 22 in an area opposite the hinge 26.

Figure 2:
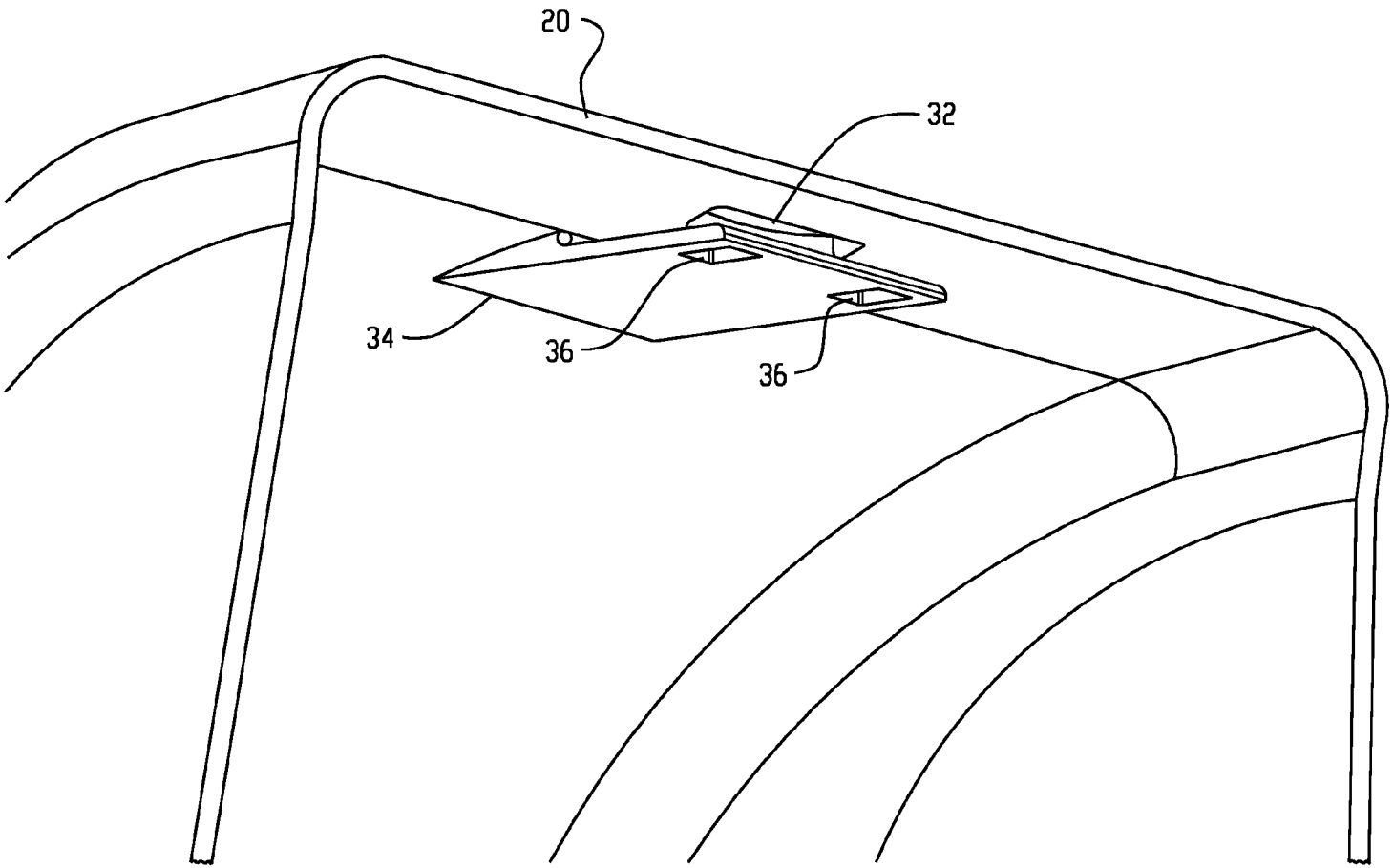
FIG. 2 is a partial perspective view illustration the dispenser cover of FIG. 1.

A latch member 34 is positioned adjacent to the hole 32. In the exemplary embodiment, the latch 34 is integrally molded with the cover 22 as illustrated in FIG. 2. However, the latch 34 may also be formed separately from the cover 22 and attached via fasteners for example. For reasons that will be made clearer herein, the latch member 34 is sized to be sufficiently elastic to allow repeated deflection under pressure from the access device 28 for the life of the dispenser 20. The latch member 34 also includes one or more holes 36. As will be discussed in more detail below, the holes 36 engage projections in the back-housing 24 to secure the top of the dispenser against the back-housing 24 when the cover 22 is in the closed position. It should be appreciated that while discussions herein refer to the latch member 34 being coupled to the cover 22 and a catch as part of the back-housing 24, these parts may be reversed without deviating from the intended scope of claimed invention.

Figure 3:
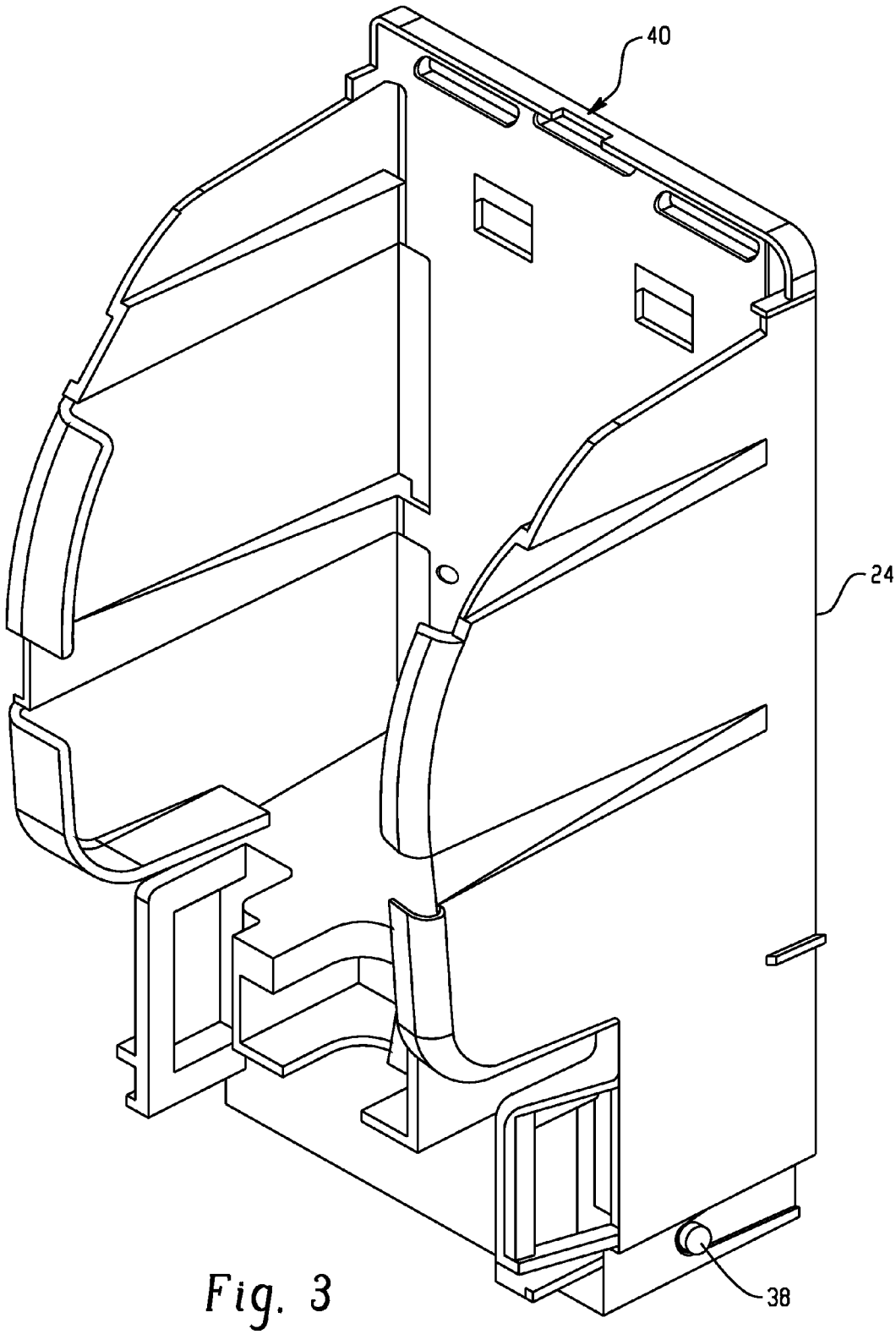
FIG. 3 is a perspective view illustration of the dispenser back-housing of FIG. 1.

The back-housing 24 includes features to support subassemblies (not shown) used in the storage and dispensing of product the user. The back-housing 24 may also incorporate features that allow the dispenser 20 to be mounted, such as to a wall, a pole or a sink for example. An exemplary embodiment back-housing 24 is illustrated in FIG. 3. As discussed above, the dispenser 20 includes a hinge 26 that allows the cover 22 to rotate relative to the back-housing 24. A portion of the hinge 26 may be incorporated into the back-housing 24, such as with a projection 38. On an end opposite the hinge projection 38, a catch 40 is integrated into the back-housing 24.

Figure 4:
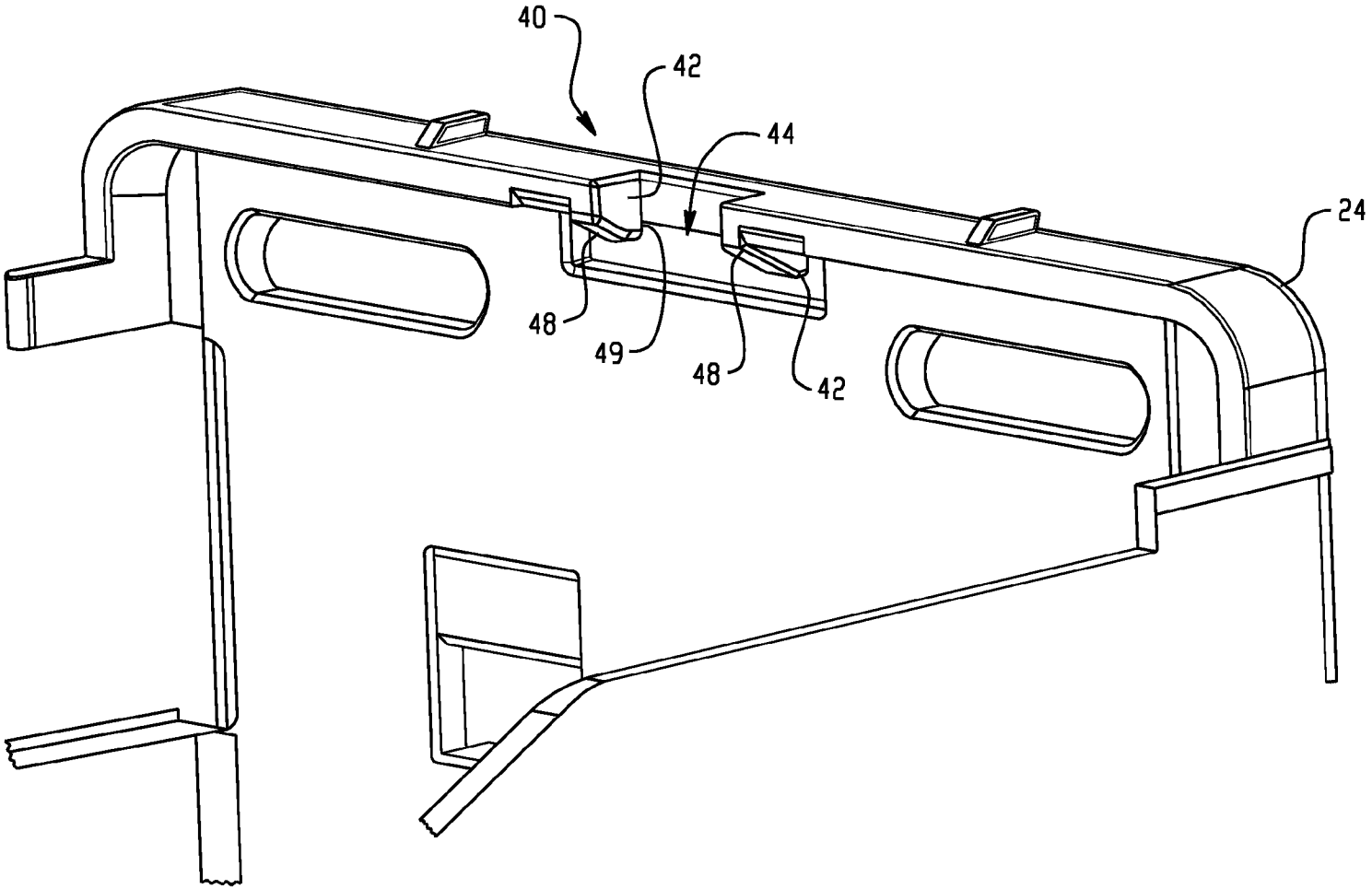
FIG. 4 is a partial perspective view illustration of the catch portion of the back-housing of FIG. 3.
Figure 6:
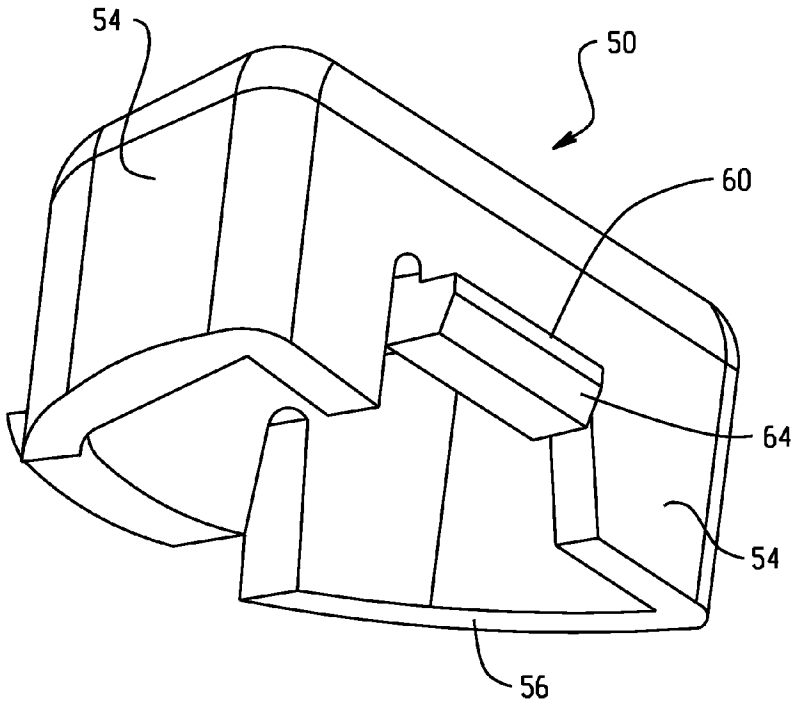
FIG. 6 is a reverse perspective view illustration of the push-button device of FIG. 5.
Figure 5:
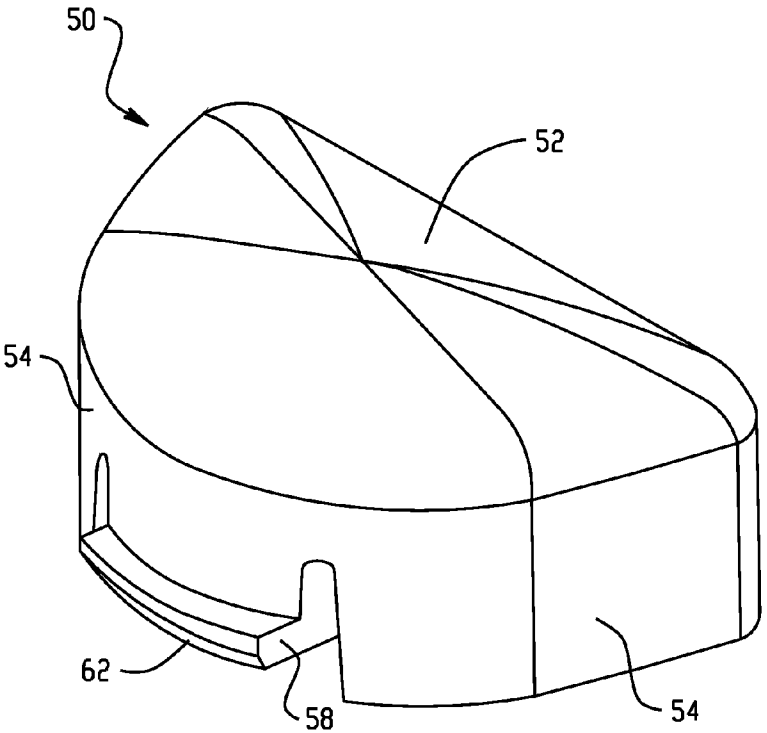
FIG. 5 is a perspective view illustration of a push-button device in accordance with an exemplary embodiment of the invention.

In the exemplary embodiment shown in FIG. 4, the catch 40 includes a pair of tabs 42 that are sized and spaced to align with the holes 36 in latch member 34. The tabs 42 include an angled surface 48 and a planar surface 49. The angled surface 48 facilitates the deflection of the latch member 34 when the cover 22 is moved towards the closed position. At a certain point during the closing of the cover 22, the leading edge of holes 32 will extend past the planar surface 49 allowing the latch member 34 to return to its original position as the tabs 42 enter into the holes 36. To facilitate the engagement of the tabs 42 into the holes 36, the back-housing 24 further includes a slot 44 adjacent to the tabs 42. The slot 44 provides clearance for the latch member 34 to extend past the surface 46 of the back-housing 24 to allow the latch member 34 to engage the tabs 42 into the holes 36. The slot 44 is further sized to allow the deflection of the latch member 34 during the engagement and disengagement of the latch member 34 from the catch 40.

The disengagement of the latch member 34 from the catch 40 is accomplished by the activation of the access device 28 that is positioned adjacent to the latch member 34 in the cover 22. The access device 28 may be any device that may be interchangeably installed in the hole 32 in cover 22. It should be appreciated that the interchangeable access device 28 provides advantages in reducing the inventory of the installer and manufacturer. The interchangeability of the access device 28 allows the manufacture and stocking of a single dispenser 20 that may be used in different applications that have different security requirements.

Exemplary interchangeable access devices 28 are illustrated in FIGS. 5-10. The first exemplary access device is a push-button device 50 illustrated in FIG. 5 and FIG. 6. The push-button device 50 includes a top surface 52 that provides an activation surface for the user to interact with the latch member 34. A plurality of walls 54 extends generally perpendicular to the surface 52 and end in a bottom surface 56. Push-button device 50 further includes a first tab 58 and a second tab 60 arranged on either side of the push-button device 50. To install the push-button device 50, the installer positions the push-button device 50 over the hole 32. The angled surfaces 62, 64 on the tabs 58, 60 contact the edge of the hole 32 causing the tabs 58, 60 to deflect inward as the installer pushed on the push-button device 50. The tabs 58, 60 provide a snap-fit into the hole 32 and retain the push-button device 50 in the cover 22. During operation, the surface 56 contacts the surface of latch member 34 in response to the operator applying a force to the surface 52 such as with one of their fingers. To replace the push-button device 50, the operator opens the cover 22 and deflects the tabs 58, 60 and pushes the push-button device 50 away from the latch member 34.

Figure 10:
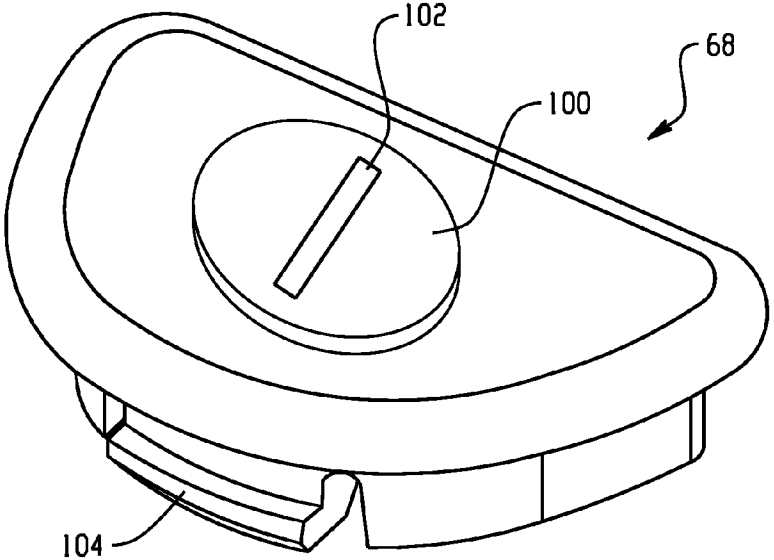
FIG. 10 is a perspective view illustration of a keyed-button device having a cylinder tumbler lock.

It should be appreciated that the push-button device 50 provides little security for the product contained in the dispenser 20. In applications where vandalism or theft is of concern to the operator, the installer may use an access device that requires a key or a tool to cause the deflection of latch member 34, such as the keyed-device 66 (FIGS. 7-9) or rotary-tumbler device 68 (FIG. 10). In these embodiments, the operator uses a key or tool to cause the latch member 34 to disengage from the catch 40. This provides a higher level of security that prevents or inhibits unauthorized access to the interior of the dispenser 20.

Figure 8:
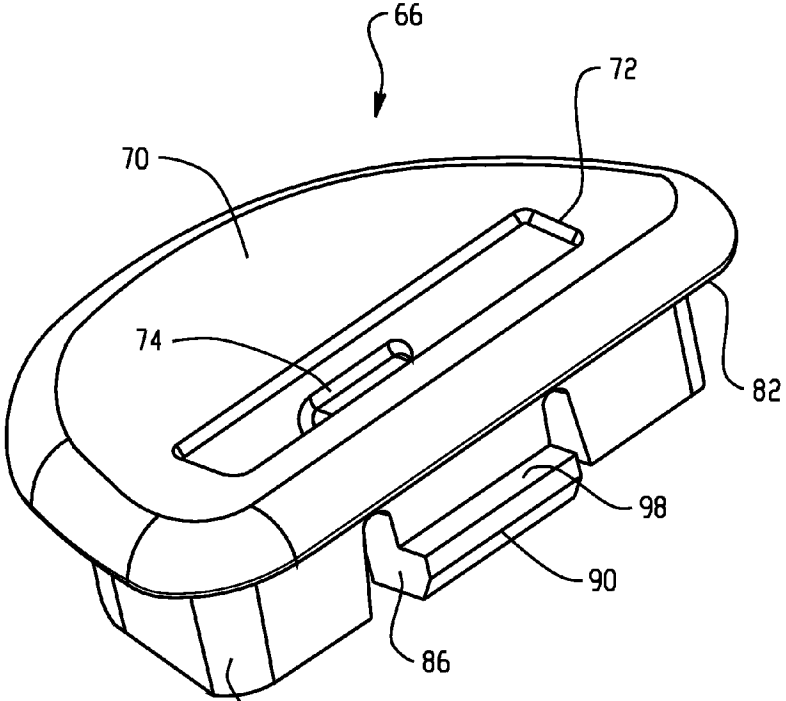
FIG. 8 is a reverse perspective view illustration of the keyed-button device of FIG. 7.
Figure 7:
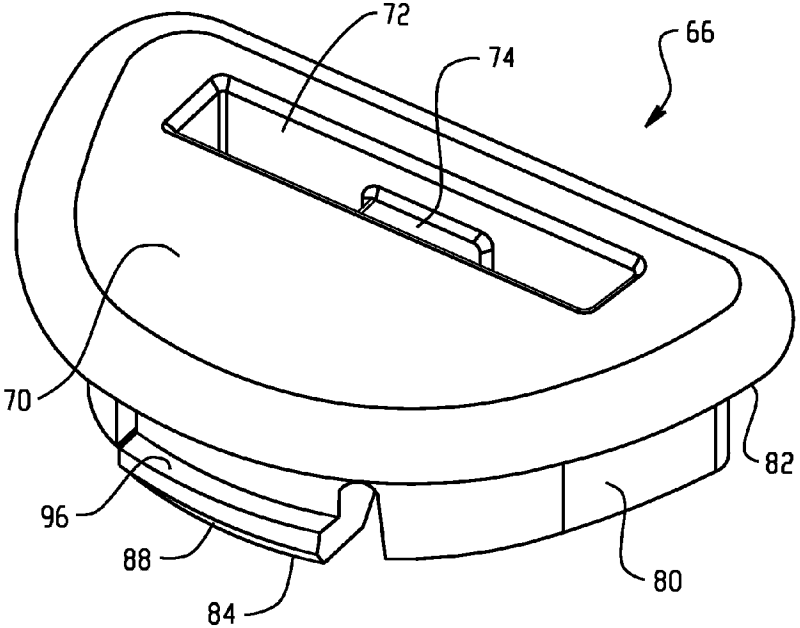
FIG. 7 is a perspective view illustration of a keyed-button device in accordance with an exemplary embodiment of the invention.
Figure 9:
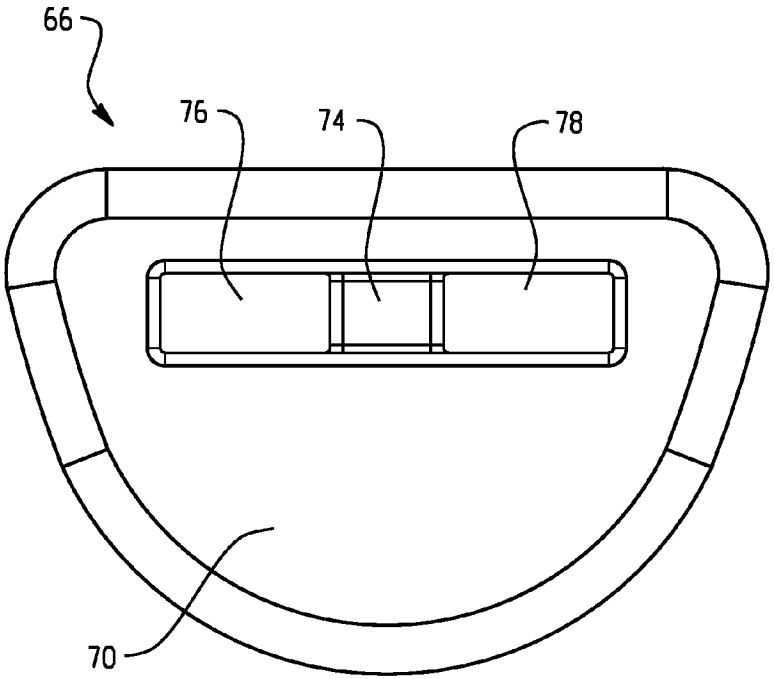
FIG. 9 is a plan view illustration of the keyed-button device of FIG. 7.

The keyed-device 66 includes a top surface 70 having an opening 72 that extends through the keyed-device 66 as shown in FIGS. 7-9. A post 74 extends across the opening 72 bifurcating the opening into two slots 76, 78. Similar to the push-button device 50, the keyed-device 66 has walls 80 that extend away from the surface 70. However, the walls 80 are offset from the edge of the surface 70 forming a lip 82. A first tab 84 and second tab 86 are formed in the walls 80. The tabs 84, 86 each include an angled surface 88, 90 to facilitate the installation of keyed-device 66 into the hole 32. The tabs 84, 86 are sized to provide a snap-fit that secures the keyed-device 66 to the cover 22. The keyed-device 66 operates with a key 92 (FIG. 13) that includes a pair of arms 94 that are sized to fit within the slots 76, 78.

As with the push-button device 50, the keyed-device 66 may be installed or removed at the point of installation of the dispenser 20. Due to the snap-fit created by the tabs 84, 86, the keyed-device 66 is installed by aligning the keyed-device 66 to the hole 32 and pushing the keyed-device into the hole. This causes the tabs 84, 86 to deflect until the keyed-device 66 is fully inserted whereupon the tabs 84, 86 will revert to their original position. The surfaces 96, 98 on tabs 84, 86 engage the underside of the cover 22 retaining the keyed-device 66 in the cover 22. To remove the keyed-device 66, the operator opens the cover, deflects the tabs 84, 86 causing the snap-fit to disengage and allowing the keyed-device to be pushed out of the hole 32.

The rotary-tumbler device 68 illustrated in FIG. 10 is similar to the keyed-device 66. However instead of having a slot that extends through, the rotary-tumbler device 68 includes a rotary pin tumbler mechanism 100. The rotary pin tumbler mechanism 100 is a lock mechanism that uses pins of varying lengths to prevent the lock from opening without the correct key. The mechanism 100 has a straight-shaped keyway 102 at one end to allow the key to enter the mechanism 100. Opposite the keyway 102 is a cam or lever (not shown) that activates the latch member 34. With a key properly cut and inserted into the keyway 102, the pins (not shown) in the mechanism 100 will rise causing them to align allowing the mechanism 100 to rotate and activate the latch member 34. When the key is not in the lock, the pins in the mechanism 100 prevent the mechanism from rotating. Similar to the push-button device 50 and the keyed-device 66, the rotary-tumbler device 68 includes tabs 104 that provide a snap-fit into the cover hole 32.

Figure 11:
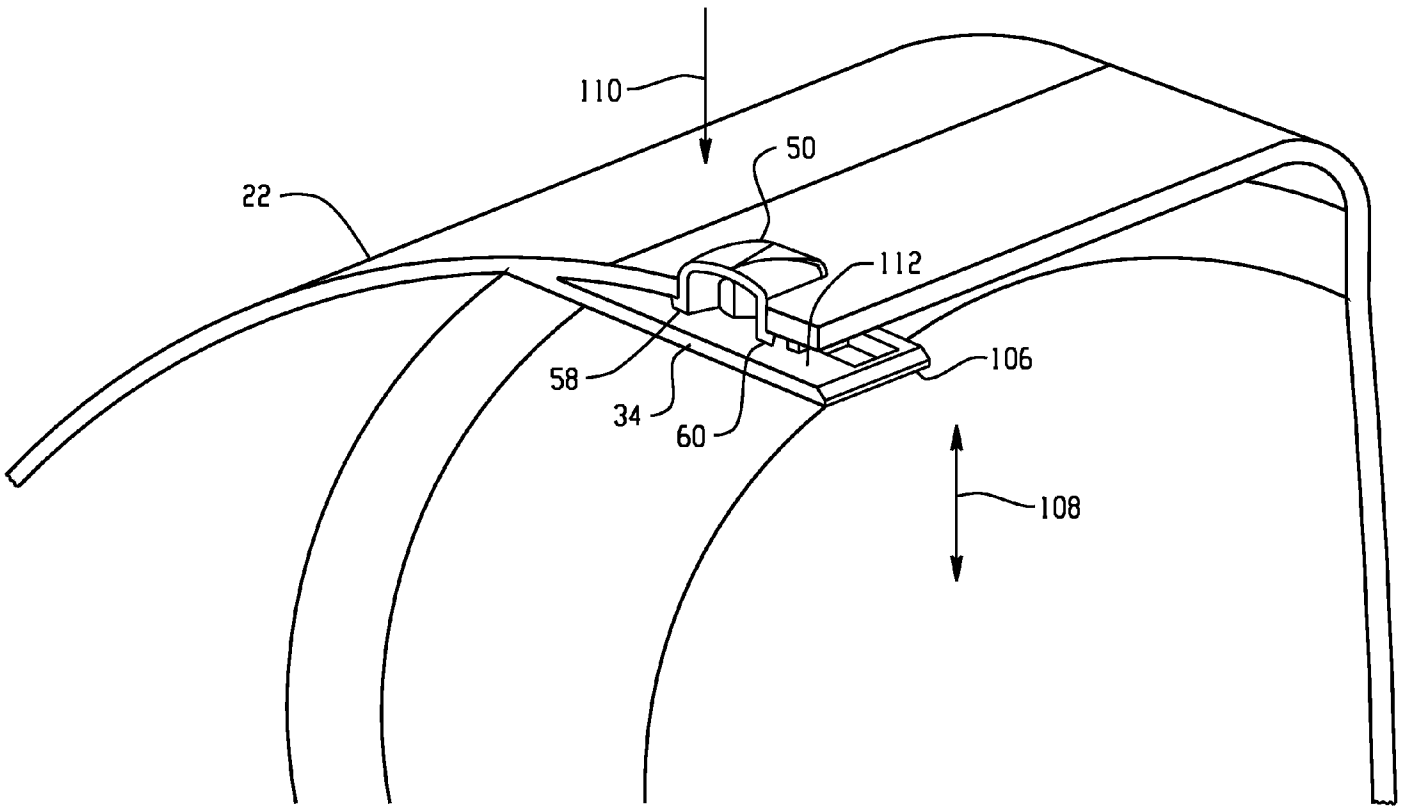
FIG. 11 is a partial sectional perspective view of the dispenser cover with the push-button device installed and the back-housing removed.
Figure 12:
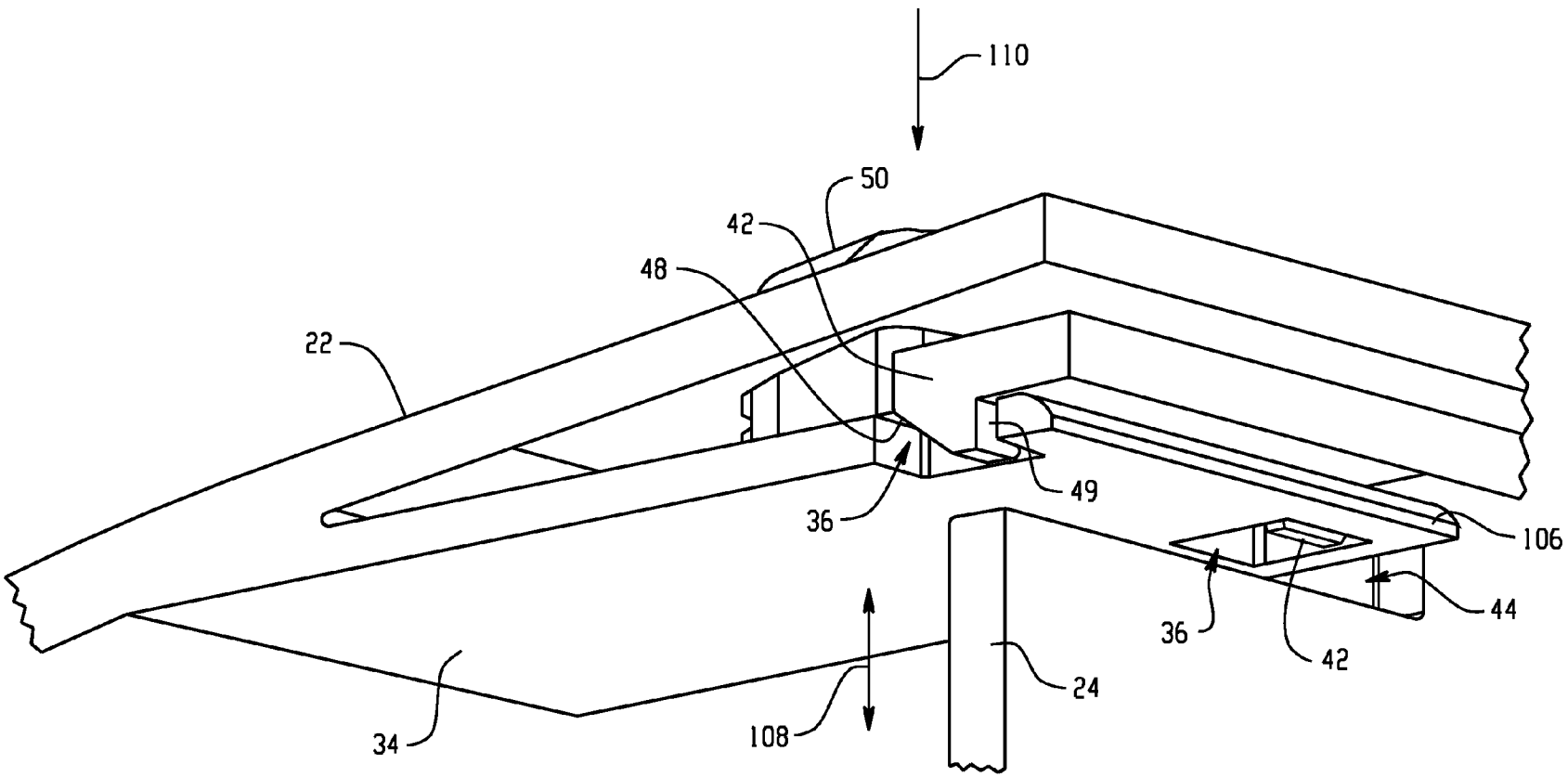
FIG. 12 is a partial sectional reverse perspective view of the dispenser cover with the push-button device installed; and, FIG. 13 is a partial sectional perspective view of the dispenser with the keyed-button device installed.

During operation, the method used by the operator to access the interior portion of the dispenser 20 will depend on which access device 28 is installed in the cover 22. Referring now to FIG. 11 and FIG. 12, the operation of the push-button device 50 will be described. When the cover 22 is moved from the open to the closed position, the latch member 34 approaches the slot 44 in the back-housing 24. The leading surface 106 of the latch member 34 contacts the angled-surface 48 on the tab 42. Due to the relative stiffness of the tab 42 in comparison to the latch member 34, the latch member 34 deflects in the direction indicated by arrow 108. As the operator continues to rotate the cover 22 towards the closed position, the latch member 34 remains in a deflected position until the holes 36 align with the tabs 42. Once the edges of the holes 36 move past the surfaces 49 of the tabs 42, the elasticity of the latch member 34 causes the latch member 34 to return to its original position. At this point, if there is an attempt to open the cover 22, the surfaces 49 of the tabs 42 will contact the sides of the holes 36 and prevent further movement. Thus, the cover is in a latched closed position and cannot be opened without taking additional action.

To open the cover 22, the operator exerts a force, such as with their hand for example, in the direction indicated by arrow 110. This causes the surface 56 on the push-button device 50 to contact the top surface 112 of the latch member 34. If the force in the direction 110 is sufficient, the latch member 34 will deflect in the direction of arrow 108 and the holes 36 will offset from the tabs 42. Once the holes 36 are clear of the tabs 42, the cover 22 may freely rotate to the open position and restocking of the product supply or maintenance tasks may be performed.

Figure 13:
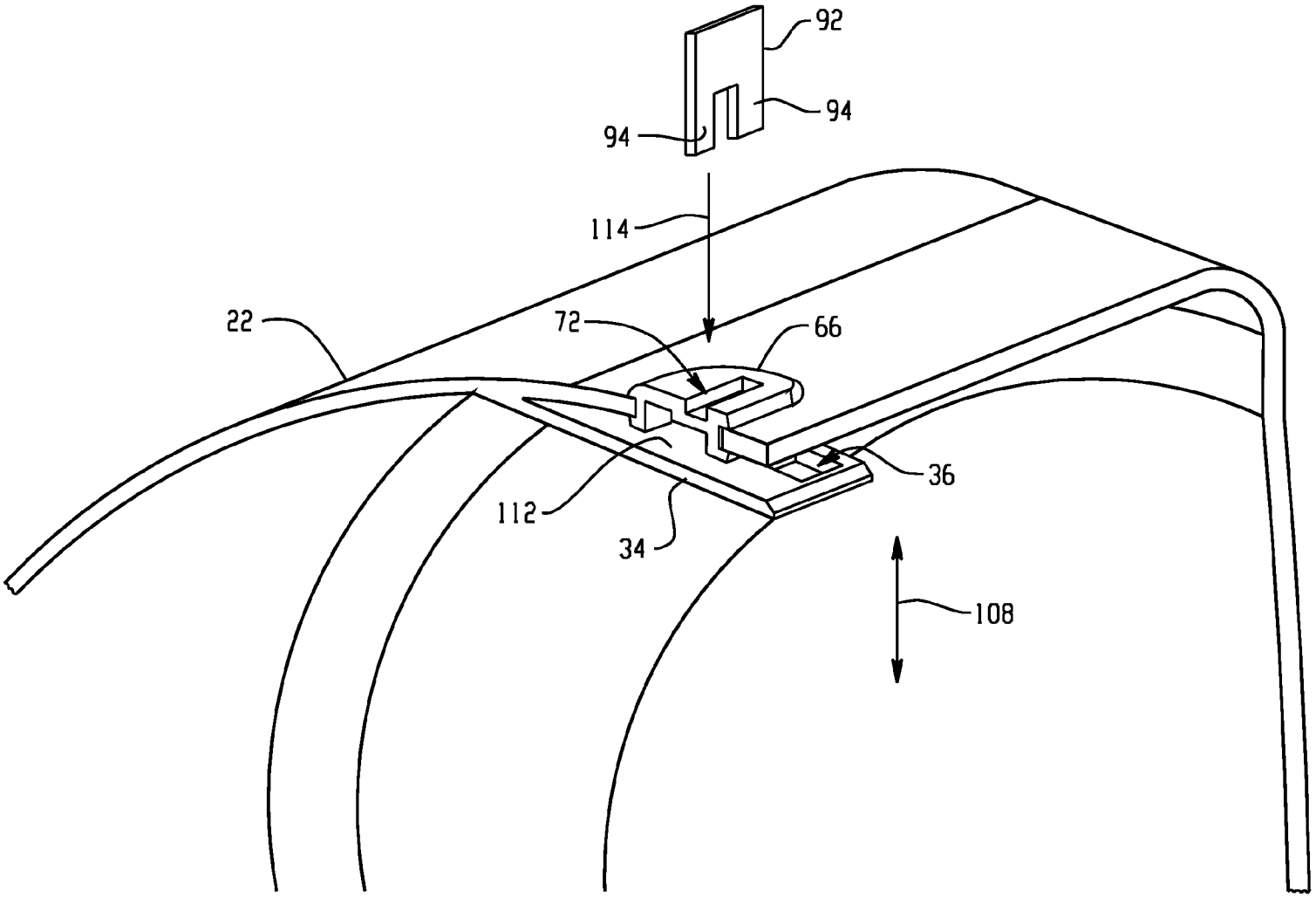

The operation of the keyed-device 66 is illustrated in FIG. 13. In this embodiment, the keyed-device 66 does not contact the latch member 34 since the lip 82 and the tabs 84, 86 prevent movement relative movement between the cover 22 and the keyed-device 66. To open the cover 22, the operator needs the key 92. The key 92 has a pair of arms 94 that straddle either side of the post 74 when the key 92 is inserted into the opening 72 in the direction indicated by arrow 114. Once inserted in the opening 72, the key 92 contacts the surface 112 of the latch member 34. If sufficient force is applied by the operator, the key 92 will cause the latch member 34 to deflect in the direction indicated by arrow 108. As described above with the push-button device 50, the deflection of the latch member 34 allows the holes 36 to clear the tabs 42 and the cover 22 may be rotated to the open position. It should be appreciated that the operation of the latch member 34 and the tabs 42 during the process of closing the cover 22 remains the same as that described above with respect to the push-button device 50.

A dispenser having interchangeable access devices 28 described herein provide a number of advantages to the manufacturer and installer of dispenser 20. By providing a fast and convenient means of changing the type of access device 28 used, the dispenser 20 reduces inventory requirements for the manufacturer and installer since only one common model of dispenser 20 needs to be stocked. The dispenser 20 also allows late point identification by the installer, or the operator, on what level of security is desired for a given application. The dispenser 20 further allows the level of security to be changed at a later date if the application or the operator so desired.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, front, rear, top, bottom etc. do not denote any orientation, order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A dispenser comprising:

a back-housing;

a catch coupled to said back-housing;

a cover movably coupled to said back-housing, said cover having a first opening;

a latch coupled to said cover, said latch cooperating with said catch to hold said cover against said back-housing when said cover is in a first position;

a push button lock disposed to be removably coupled to said first opening; and, a keyed device disposed to be removably coupled to said first opening;

wherein said push button lock and said keyed device are mutually interchangeable with each other for being removably coupled to said first opening by a user.

2. The dispenser of claim 1 wherein said push button lock when disposed in said opening cooperates with said latch to disengage said latch from said catch when said push button lock is moved from a second position to a third position.

3. The dispenser of claim 2 wherein said keyed device further includes a second opening sized to receive a key, wherein said key cooperates with said latch to disengage said latch from said catch when said key is inserted in said second opening.

4. The dispenser of claim 3 wherein said cover is arranged to move from said first position to a fourth position when said latch is disengaged from said catch.

5. The dispenser of claim 4 wherein said push button lock includes a first tab that engages said cover with a snap-fit, wherein said push button is in said second position when said tab is in contact with said cover.

6. The dispenser of claim 5 wherein said keyed device includes a second tab that engages said cover with a snap-fit.

7. The dispenser of claim 6 wherein said keyed device includes a lip disposed adjacent said second tab, wherein said lip contacts a surface of said cover when said keyed device is positioned in said opening.

8. The dispenser of claim 7 wherein said keyed device opening is bifurcated into a third opening and a fourth opening, said third opening sized to receive a first portion of said key and said fourth opening sized to receive a second portion of said key wherein said key first portion and said second key portion are arranged to cooperate with said latch to disengage said latch from said catch.

9. The dispenser of claim 8 wherein said third opening and said fourth opening extend through said keyed device, such that when said key is inserted in said third opening and said fourth opening, said key contacts said latch and moves said latch to disengage said latch from said catch.

10. The dispenser of claim 7 wherein said keyed device opening is in a cylinder tumbler lock, wherein said cylinder tumbler lock engages said latch when a key is rotated in said tumbler lock.

11. A dispenser comprising:

a back-housing having a first end and a second end, said back-housing having a catch adjacent said first end;

a cover having a first opening adjacent a third end, and a fourth end opposite said third end, said fourth end being coupled for rotation to said back-housing second end, wherein said cover is movable between a first position and a second position;

a latch member coupled to said cover, said latch member being removably coupled to said catch when said cover is in said first position; and, an interchangeable access device having a tab, said tab being sized to allow said access device to be removably coupled to said cover in said first opening and operably coupled to said latch, wherein said access device is user selectable between a push-button device or a keyed device.

12. The dispenser of claim 11 wherein said push-button device is movable within said opening between a third position and a fourth position, said push-button device further including a first tabbed portion, wherein said first tabbed portion engages said cover when said push-button device is in said third position.

13. The dispenser of claim 12 wherein said push-button device cooperates with said latch to disengage said latch from said catch when said push-button device is in said fourth position.

14. The dispenser of claim 13 wherein said keyed device includes a second opening therethough, wherein said second opening is sized to receive a key that cooperates with said latch to disengage said latch from said catch when said key is inserted in said second opening.

15. The dispenser of claim 14 wherein said keyed device includes a second tabbed portion adjacent a first side and a lip adjacent a second side, wherein said second side is opposite said first side, wherein said tabbed portion and said lip being positioned to engage said cover when said keyed device is positioned within said first opening.

16. A dispenser kit comprising:

a back-housing having a catch;

a cover rotatably coupled to said back-housing at a first end, said cover movable between a first and second position, said cover having a first opening;

a latch coupled to said cover adjacent said first opening and positioned to engage said catch when said cover is in said first position;

a first access device being sized to movably fit in said first opening, said first access device being movable between a third position and a fourth position when positioned in said first opening; and, a second access device being sized to fit in said opening with a snap-fit, said second access device having a second opening;

wherein said first access device and said second access device are mutually interchangeable with each other for being positioned in said first opening and wherein said first access device and said second access device each cooperate with said latch to disengage said latch from said catch.

17. The dispenser kit of claim 16 further comprising a key sized to fit in said second opening, wherein said latch disengages from said catch when said key is inserted in said second opening when said second access device is positioned within said first opening.

18. The dispenser kit of claim 17 wherein said first access device disengages said latch from said catch when said first access device is positioned within said first opening and moved to said fourth position.

19. The dispenser kit of claim 18 wherein said second access device includes a first tab on one end and a lip on an opposite end, wherein said first tab engages one side of said cover and said lip engages an opposite side of said cover when said second access device is position within said first opening.

20. The dispenser kit of claim 19 wherein said first access device includes a second tab, wherein said second tab engages a side of said cover adjacent to said latch when said first access device is positioned within said first opening.

* * * * *